United States Patent [19]

Garnjost et al.

[11] 4,338,965

[45] Jul. 13, 1982

[54] SELF-MONITORING DUAL-SPOOL SERVOVALVE

[75] Inventors: Kenneth D. Garnjost, Orchard Park; John S. Ballard, South Wales, both of N.Y.

[73] Assignee: Moog Inc., East Aurora, N.Y.

[21] Appl. No.: 155,550

[22] Filed: Jun. 2, 1980

[51] Int. Cl.[3] ..... F15B 13/043; F15B 20/00

[52] U.S. Cl. ..... 137/554; 91/31; 91/363 A; 91/437; 91/510; 137/596.16

[58] Field of Search ..... 91/31, 363 A, 424, 437, 91/509, 510; 137/554, 596.16

[56] References Cited

U.S. PATENT DOCUMENTS

| | | | |
|---|---|---|---|
| 3,139,109 | 6/1964 | Ruchser | 137/596.16 |
| 3,270,623 | 9/1966 | Garnjost et al. | |
| 3,338,138 | 8/1967 | Wood . | |
| 3,338,139 | 8/1967 | Wood . | |
| 3,554,084 | 1/1971 | Rasmussen et al. | 91/509 X |
| 3,937,254 | 2/1976 | Stahle | 137/596.16 X |
| 4,009,642 | 3/1977 | Vanderlaan | 91/363 A X |

FOREIGN PATENT DOCUMENTS

| | | | |
|---|---|---|---|
| 673372 | 6/1952 | United Kingdom . | |
| 673375 | 6/1952 | United Kingdom . | |
| 937487 | 9/1963 | United Kingdom . | |
| 1221451 | 2/1971 | United Kingdom . | |
| 1341290 | 12/1973 | United Kingdom . | |
| 663932 | 5/1979 | U.S.S.R. | 137/596.16 |

OTHER PUBLICATIONS

W. J. Thayer, Technical Bulletin 127, *Redundant Electrohydraulic Controls*, Published May, 1976 by Moog, Inc.

*Primary Examiner*—Gerald A. Michalsky
*Attorney, Agent, or Firm*—Sommer & Sommer

[57] ABSTRACT

An improved electrohydraulic servovalve has first and second valve spools mounted for independent sliding movement relative to a body in response to a common command signal. The valve has a first drive mechanism operatively arranged to cause a desired motion of one valve spool in response to the command signal, and has a second drive mechanism operatively arranged to cause a desired simultaneous similar motion of the other valve spool in response to the command signal. The improvement comprises a differential position sensing mechanism arranged to sense the relative positions of the two valve spools and operative to produce an output related to the difference therebetween, and an indicating device supplied with such output and operative to indicate substantially dissimilar relative positions of the spools.

26 Claims, 6 Drawing Figures

SELF-MONITORING DUAL-SPOOL SERVOVALVE

BACKGROUND OF THE INVENTION

1. Field of the Invention

The present invention relates generally to the field of servovalves, and more particularly to apparatus for monitoring the relative positions of two similarly-movable valve spools, and for indicating the differential therebetween as a measure of servovalve failure.

2. Prior Art

From a functional point of view, an electrohydraulic servovalve is a device for converting an electrical command signal into a desired flow of hydraulic fluid. Such servovalves have been developed in various structural forms, and have found application in a myriad of systems.

In some servosystems, typically those which require higher-than-normal reliability, it may be desirable to provide the feature of redundancy, such that a failure in one part of the system may be detected and corrected. Such redundant servosystems have been typically provided in aircraft, space vehicle and nuclear applications.

The use of "fly-by-wire" (FBW) systems for flight control of aerospace vehicles has increased steadily in recent years. Such systems use electrohydraulic servoactuators to position the maneuvering surfaces of airplanes, or the movable thrust vector of space vehicles. Pilot or autopilot commands are translated into electrical position commands to servoactuators. FBW has reduced the weight and performance limitations of conventional mechanical controls, in that linkage, levers and cables between the pilot controls and the flight surfaces are largely eliminated. The safety of passengers and crew of the vehicle depends upon correct operation of the FBW system, which must be capable of providing continued safe flight despite failure of one or more system components. Hence, the need for redundant control systems.

Representative examples of the pertinent prior art may be found in U.S. Pat. Nos. 3,338,138; 3,338,139; 3,270,623; and in Technical Bulletin 127, *Redundant Electrohydraulic Servoactuators,* published in 1976 by Moog Inc.

SUMMARY OF THE INVENTION

The present invention provides a unique improvement for use in a redundant servovalve having first and second valve spools mounted for independent sliding movement relative to a body. Such a servovalve, usually of the electrohydraulic type, typically has a first drive mechanism operatively arranged to cause a desired motion of the first valve spool in response to a command signal, and a second drive mechanism operatively arranged to cause a desired simultaneous similar motion of the second spool in response to the same command signal.

The improvement broadly comprises: a differential position sensing mechanism arranged to sense the relative positions of the spools and operative to produce an output related to the differential therebetween; and an indicating device supplied with such mechanism output and operative to indicate dissimilar relative positions of the spools.

In the preferred embodiment, the sensing mechanism is a device which converts differential spool position into a mechanical output, and the indicating device is an electromechanical transducer arranged to convert such mechanical output into a desired electrical signal.

Accordingly, the general object of the present invention is to provide an improved self-monitoring dual-spool servovalve.

Another object is to provide an improved dual-spool servovalve having means for sensing differential spool position and using such differential as an indicator of servovalve failure.

Another object is to provide an improved dual-spool servovalve for possible use in a redundant control system, wherein a servovalve failure may be detected and corrected before the effect of such failure has produced a concomitant error in the position of a load.

Another object is to provide an improved sensing mechanism for use in such a servovalve, which mechanism is structurally simple, practical, and cost effective.

These and other objects and advantages will become apparent from the foregoing and ongoing specification, the drawings and the appended claims.

DESCRIPTION OF THE PREFERRED EMBODIMENTS

Figure 1:
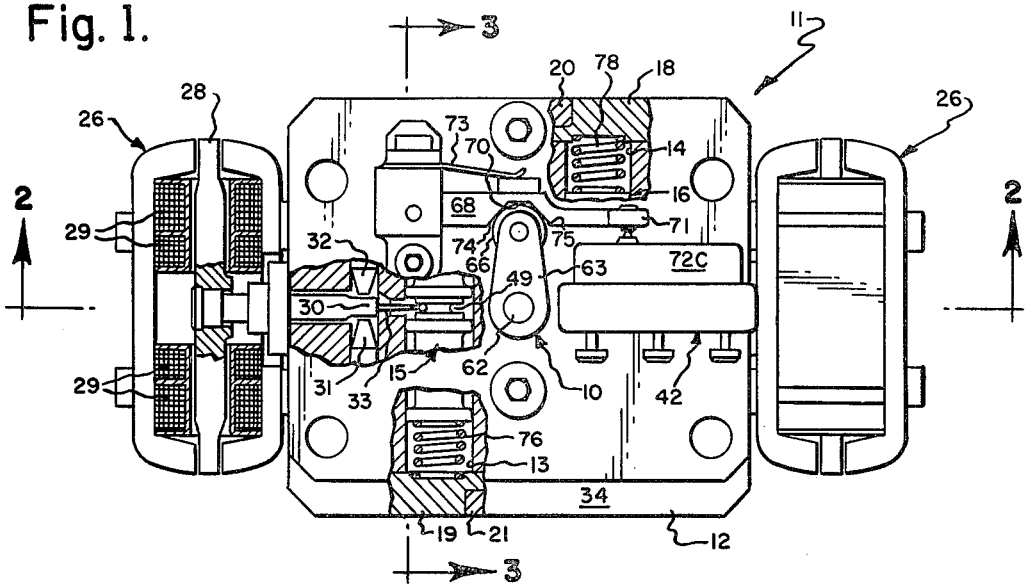
FIG. 1 is a top plan view of a structurally abbreviated dual-spool self-monitoring electrohydraulic servovalve incorporating the present improvement, with portions thereof broken away to illustrate internal details.

At the outset, it should be clearly understood that like reference numerals are intended to identify the same elements and/or structure consistently throughout the several drawing figures, as such elements and/or structure may be further described or explained by the entire written specification of which this detailed description is an integral part.

Figure 2:
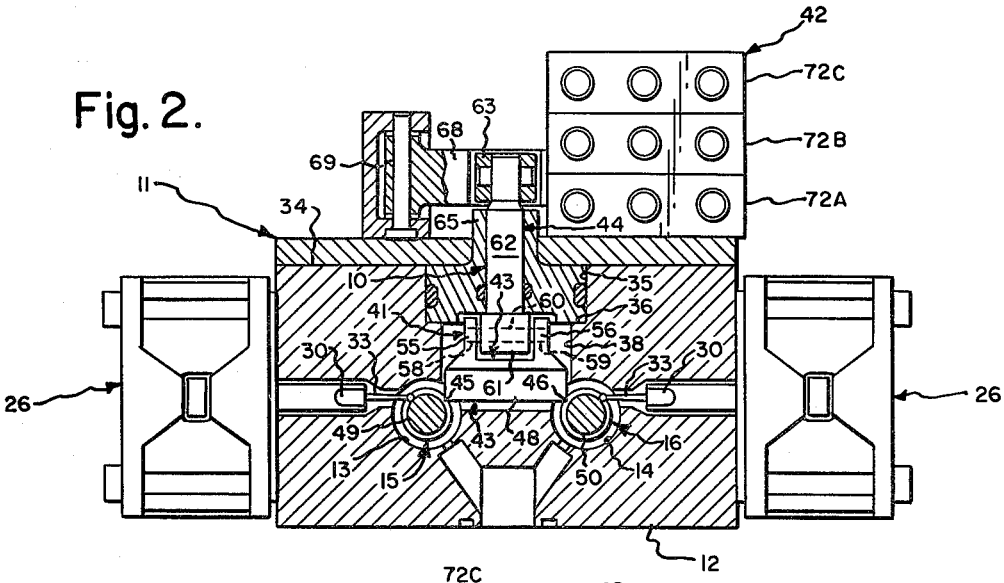
FIG. 2 is a vertical sectional view thereof, taken generally on line 2—2 of FIG. 1.
Figure 3:
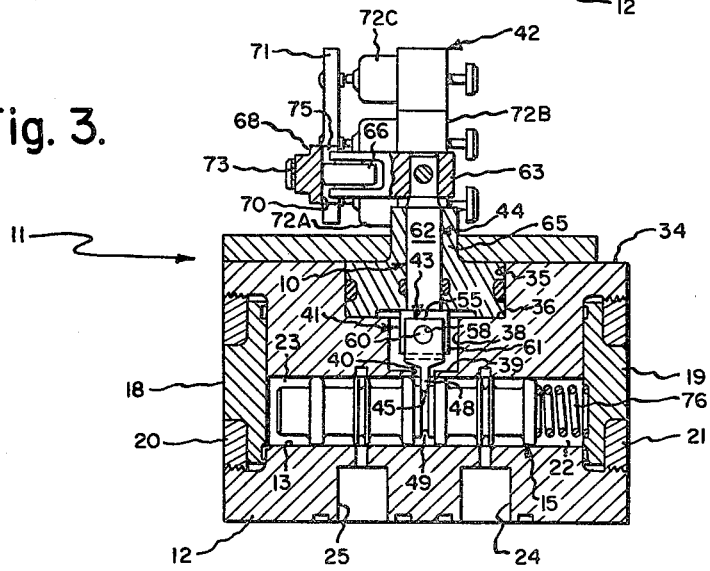
FIG. 3 is a vertical sectional view thereof, taken generally on line 3—3 of FIG. 1.

Referring now to the drawings, and more particularly to FIGS. 1–3 thereof, the invention provides a unique improvement, of which the presently preferred embodiment is generally indicated at 10, for use in an electrohydraulic servovalve, of which one species is generally indicated at 11.

Structure (FIGS. 1–3)

In FIGS. 1–3, the illustrated servovalve is shown as being of the two-spool flow-sum type. In order to more clearly illustrate the improved feature, some structural details of the servovalve, such as wires, orifices and fluid flow passages, have been omitted. Such omitted structure is clearly known by persons skilled in this art, and it is felt that its inclusion might otherwise obfuscate the illustration of the specific improvement claimed herein. Hence, the illustrated servovalve 11 should be regarded as somewhat schematic.

Servovalve 11 is shown as having a central body 12 provided with a pair of spaced parallel left and right horizontal through-bores 13, 14, which slidably accommodate left and right valve spools 15, 16, respectively. The ends of bores 13, 14 are closed by suitable end caps 18, 19 (FIG. 3), which are received in cooperatively-configured recesses provided in the body. Retaining rings 20, 21 are arranged to releasably secure the end caps 18, 19 to the body. Hence, end chambers 22, 23 are provided at opposite ends of each spool. In the well known manner, a pressure differential may be supplied to these end chambers to move the associated spool in a desired direction relative to the body. Such motion may cause ports 24, 25 in the body to become uncovered to establish a metered flow through each valve. For clarity of illustration, the various other ports communicating with through-bores 13, 14 have been omitted from the drawings.

As best shown in FIGS. 1 and 2, a torque motor, generally indicated at 26, is operatively associated with each valve spool. These torque motors are well known by persons skilled in this art, and need not be fully described herein. Briefly, each torque motor has a T-shaped armature-flapper member (FIG. 1). The ends of the armature 28 are movably mounted between opposing faces of spaced polepieces. Hence, a suitable electrical command signal may be supplied to the coils 29 of the torque motor to cause the armature to move substantially pivotally. Such motion of the armature causes the flapper 30 to move relative to a pair of opposing nozzles 31, 32, through which fluid is continuously discharged. A pressure differential, established by the position of flapper 30 relative to nozzles 31, 32 is applied through suitable passageways (not shown) to the spool end chambers 22, 23 to move the associated spool in the desired direction. However, as the spool so moves, a mechanical feedback spring wire 33 pulls the flapper back to a centered position between the nozzles. When this occurs, the pressures in the spool end chambers are essentially equal, and the spool stops at a new position displaced from its original position. In the preferred embodiment, such displacement of each spool is proportional to the magnitude of the command signal supplied to the torque motor. The direction of such spool displacement is determined by the polarity of the command signal. In such a servovavle, the nozzle-flapper arrangement may be regarded as a first-stage hydraulic amplifier, which is used to displace a second-stage valve spool to meter flow through the valve. With a flow-sum servovalve, the command signal is simultaneously applied to both torque motors. Hence, in normal operation, a given command signal will produce simultaneous similar movement of valve spools 15, 16. The fluid metered by each spool is supplied through ports 24, 25, and combined in an external manifold device (not shown). Hence, the name "flow-sum".

As best seen in FIGS. 2 and 3, a stepped recess extends downwardly from the top surface 34 of the body to communicate with the through-bores 13, 14. The recess is bounded by an upper cylindrical wall 35 extending downwardly from body top surface 34, an upwardly-facing annular horizontal shoulder 36, a rectangular wall portion 38 continuing downwardly therefrom, an upwardly-facing horizontal shoulder 39, and a narrowed slot-like rectangular wall portion 40 continuing downwardly therefrom and communicating with through-bores 13, 14.

Referring now collectively to FIGS. 1-4, the present improvement 10 broadly comprises a differential position sensing mechanism, generally indicated at 41, arranged to sense the relative positions of valve spools 15, 16 and operative to produce an output related to the differential position therebetween; and an indicating device, generally indicated at 42, supplied with the output from the differential position sensing mechanism and operative to indicate relative dissimilar positions of the spools.

Figure 4:
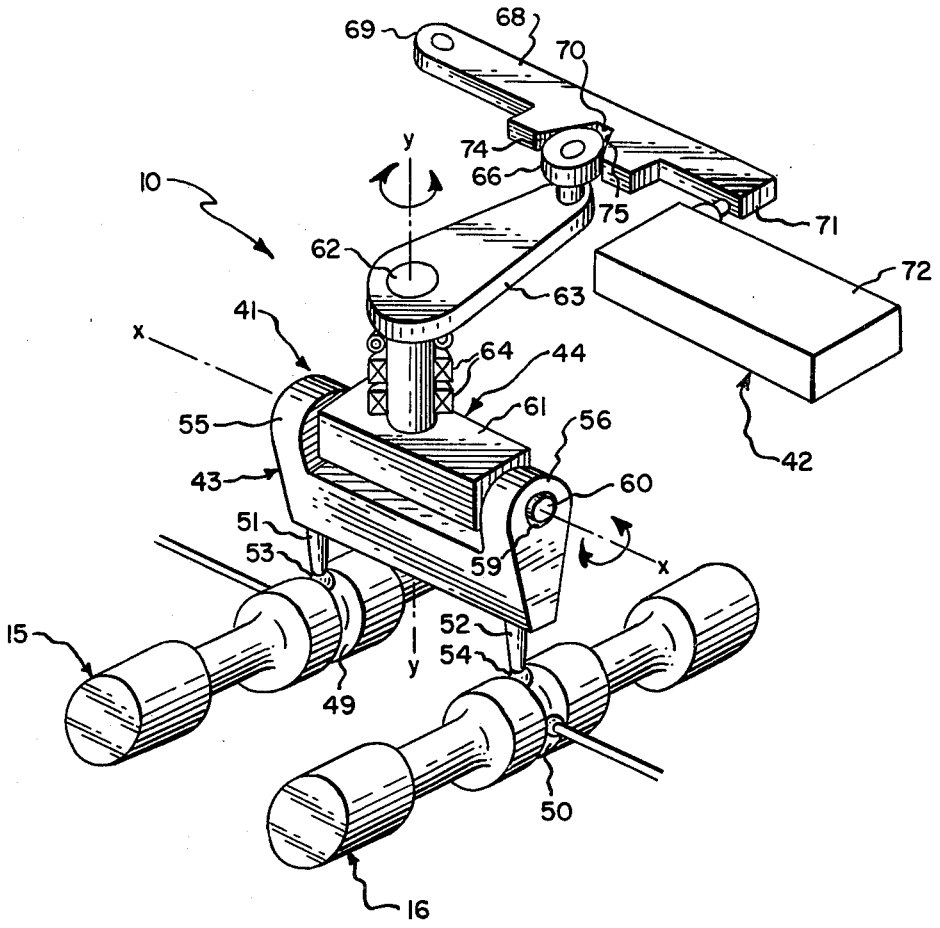
FIG. 4 is a perspective schematic view of the presently preferred form of the differential position sensing mechanism operatively interposed between the two spools and one snap action switch.

As best shown in FIG. 4, the differential position sensing mechanism 41 is shown as including a lower first member 43 mounted for pivotal movement about a horizontal first axis x—x, and an upper second member 44 mounted for pivotal movement about a second vertical axis y—y arranged to perpendicularly intersect the first axis.

The first member 43 is depicted as being clevis-like having the left and right corners of 45, 46 of a lowermost blade 48 (FIGS. 2 and 3) suitably captured in annular grooves 49, 50 of spools 15, 16. In FIG. 4, these blade corners 45, 46 have been mechanically simplified to appear as depending legs 51, 52 provided with terminal ball heads 53, 54 suitably captured in valve spool grooves 49, 50. Persons skilled in this art will readily appreciate that these two arrangements are mechanically and functionally equivalent, and may be interchanged as desired. The upstanding ear portions 55, 56 of the clevis member are provided with aligned horizontal through-holes 58, 59, respectively, to accommodate passage of a pin 60 by which the upper and lower members may be pivotally connected. The first or x—x axis is coincident with the axis of pin 60.

The second member 44 is shown as broadly including a rectangular block 61 positioned between the clevis legs and provided with a horizontal hole through which pin 60 may pass, a shaft member 62 extending vertically upwardly from block 61, and a horizontal arm 63 mounted on the upper end of shaft 62. Vertical axis y—y is coincident with the axis of shaft 62. Shaft 62 is journalled by means of suitable bearings 64 in a closure gap 65 suitably secured to the body. A freely-rotatable roller 66 is mounted on the distal end of arm 63 for a purpose hereinafter apparent.

The indicating device 42 is shown as including an arm 68 having its left marginal end portion 69 pivotally mounted on the body, an intermediate notch 70 receiving roller 66, and having its rightward marginal end portion 71 arranged to engage the actuator of a snap-action switch 72. In the preferred embodiment, lever arm 68 is biased to continuously engage wheel 66 by a leaf spring 73 (FIG. 1). Also, in the preferred embodiment, the arm end portion 71 is arranged to simultaneously operate the actuators of three separate snap-action switches, severally identified at 72A, 72B and 72C (FIGS. 2 an 3), used in a triplex system.

Operation (FIG. 4)

During normal operation, a command signal is simultaneously supplied to both torque motors to produce similar, and hopefully identical, movements of the two spools relative to the body. In FIG. 4, such simultaneous motion of spools 15, 16 will cause the lower member 43 to pivot about the horizontal x—x axis, without producing any rotational movement of the upper member 44 about the vertical y—y axis. Hence, simultaneous similar motion of the spools will not cause any movement of indicator arm end portion 71 relative to the switch 72.

However, should a failure somewhere in the valve cause the relative positions of the spools to vary, as by one spool moving relative to the other, such dissimilar spool motion will cause the lower member 43 to pivot about vertical axis y—y, cause roller 66 to ride on one of the inclined planes 74, 75 forming notch 70, and cause actuator arm marginal end portion 71 to move to operate switch 72, thus indicating a failure somewhere which caused the dissimilar motions of the spools. The operation of switch 72 may be used in a number of different ways. For example, operation of switch 72 might be used to automatically shift the flow control function to a standby system, as described infra.

When the servovalve is operating normally, each spool may experience a working stroke on the order of ±0.010 to 0.030 inch, and the two spools may be expected to track one another within ±0.002 inches. It is quite practical to build an actuating mechanism which will operate switch 72 repeatedly within a band of ±0.002 inches or better. Hence, it is entirely feasible to design such a device which will, for example, reliably indicate when the spools are more than 50% misaligned, but which will always be untripped when the spools are within ±25% of one another. Moreover, when the spools are moving within their normal tracking tolerance of about ±15%, the backlash inherent in the mechanism will cause only the lower member 43 to move, thus eliminating friction and spring reaction forces on the spools and preventing undesired seal, cam and switch wear. However, when one spool is displaced from 25 to 50% with respect to the other, the upper member 44 will be positively driven to move roller 66 along cam surface 74, or 75, and thus operate the switch.

Another feature of the present invention, is the optional presence of checkout springs 76, 78. As best shown in FIGS. 1 and 3, checkout spring 76 is operatively arranged in one end chamber to act between end cap 19 and the facing end of spool 15. The other checkout spring 78 is operatively arranged in the opposite end chamber to act between opposite end cap 20 and the facing end of spool 16. Hence, these two checkout springs act on opposite ends of the two spools to drive the spools to dissimilar positions in the absence of a hydraulic pressure in the spool end chambers. This feature is advantageous in positively providing a failure indication, by operation of snap-action switch 72, before the system is turned on and the spool end chambers pressurized. Hence, an operator may test indicator operation by observing that an initial failure signal, produced by switch 72, is corrected by appropriate pressurization of the spool end chambers.

Figure 5:
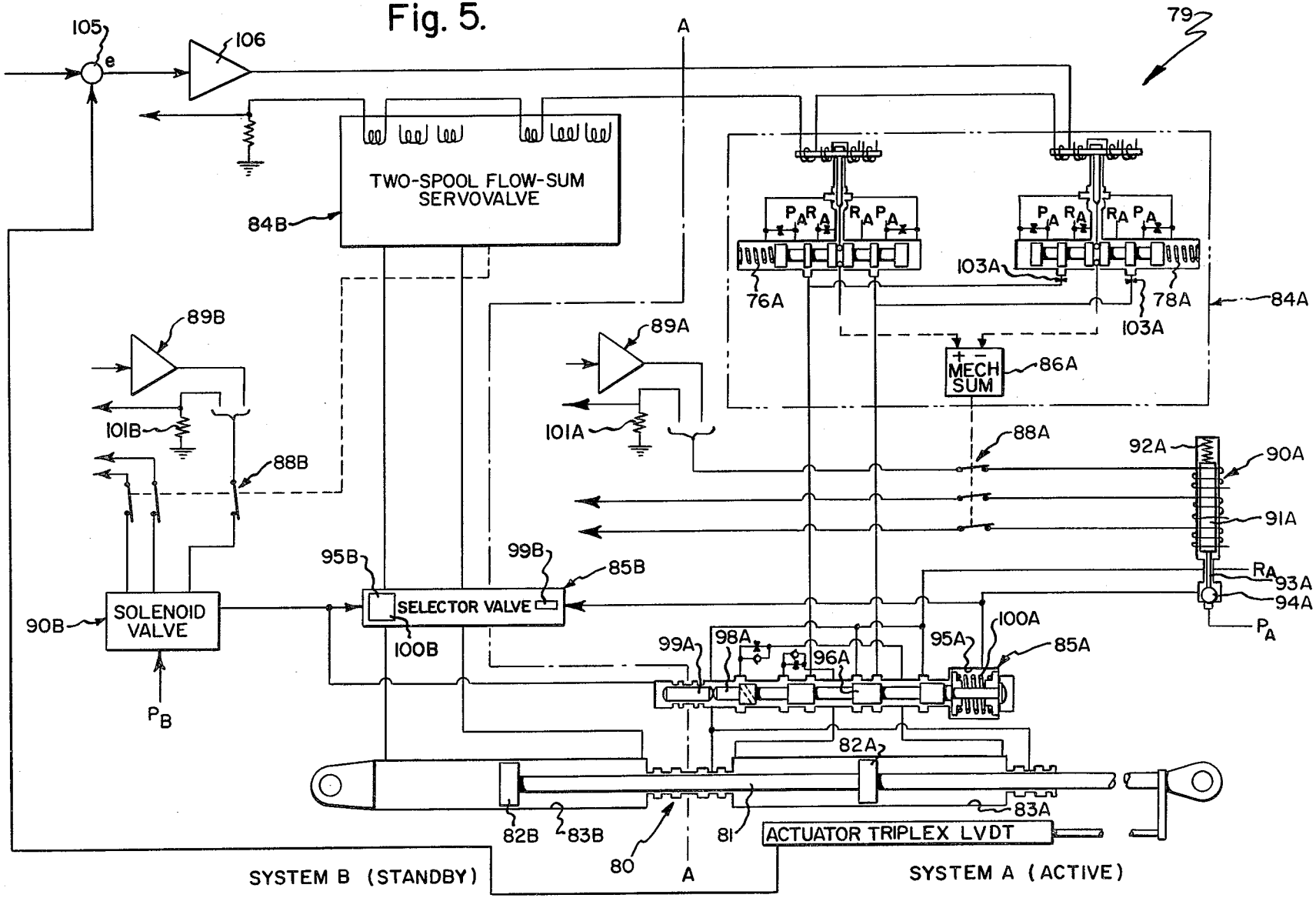
FIG. 5 is a schematic view of a redundant control system having an active system arranged to selectively control a tandem actuator, and having a standby system selectively decoupled from said actuator.

Redundant Control System Application (FIG. 5)

The utility of the inventive improvement may be seen from its possible application to a redundant control system, generally indicated at 79 in FIG. 5.

Control system 79 is redundant in the sense of having two alternate systems separated by a line A—A. To the right of line A—A is system A, which is the active system used to control tandem actuator 80. To the left of line A—A is system B, which is a secondary system in a standby condition. Should system A fail, a switching control will reverse the operative conditions of the two systems, that is, system B will become active and system A will be rendered inoperative. Systems A and B are substantially identical to one another. For convenience, reference numerals will be followed by the suffixes A and B to distinguish between the corresponding structure of systems A and B, respectively.

Tandem actuator 80 is shown as having a horizontally-elongated rod 81 upon which pistons 82A, 82B are mounted. Piston 82A is slidably mounted in a cylinder 83A, and piston 82B is slidably mounted in a cylinder 83B. In system A, a two-spool flow-sum electrohydraulic servovalve 84A, which may be of the type shown in FIGS. 1–4, is operatively arranged to control the flow of fluid with respect to the actuator's complementary chambers on opposite sides of piston 82A, via an intermediate selector valve 85A. Similarly, in system B, a two-spool flow-sum servovalve 84B is arranged to control the flow of fluid with respect to the actuator's complementary chambers on opposite sides of piston 82B, via an intermediate bypass valve 85B.

Servovalve 84A is shown as incorporating the inventive differential position sensing mechanism 86A, the output of which is used to control a triplex snap-action switch bank 88A. The servovalve of system B also incorporates a similar differential position sensing mechanism (not shown), the output of which controls a triplex snap-action switch bank 88B.

The active system also includes three multi-level solenoid drivers, one of which is indicated at 89A, which control the operation of a solenoid valve 90A through normally-closed switch bank 88A. These solenoid drivers also include a current sensing resistor 101A. Each driver is arranged to have two main current levels: a higher level for initially moving the solenoid plunger 91A upwardly against the bias of spring 92A, and a lower level for subsequently holding the plunger in such displaced position. Of course, this does not preclude the application of a still further reduced current level to test circuit continuity. Hence, each solenoid driver is capable of providing four modes: (1) "off"; (2) a "low level" to test circuit continuity and whether switch 88 is closed; (3) an "intermediate level" to hold the solenoid plunger in a displaced position; and (4) a "high level" to displace the solenoid plunger. Level 2 is particularly useful in providing continuous monitoring of the status of the standby system. The solenoid drivers for the other two channels in system A have been omitted from the drawings. System B has three-dual level solenoid drivers, one of which is indicated at 89B, for similarly controlling the operation of solenoid 90B.

The plunger 91A of solenoid 90A has an integral pin 93A extending downwardly therefrom. The lower end of pin 93A is adapted to selectively engage a ball 94A arranged in a small lower chamber. Fluid at supply pressure $P_A$ is supplied to the bottom of this ball-containing chamber, and is also supplied to the servovalve 84 A. When solenoid valve 90A is energized to raise plunger 91A, supply pressure $P_A$ will force ball 94A to move upwardly and seat against the top wall of the ball-containing chamber, thereby sealingly separating the supply pressure $P_A$ from a line venting the narrowed neck of the solenoid chamber with a return $R_A$. When the solenoid valve 90A is deenergized, spring 92A forces plunger 91A to move downwardly to cause ball 94A to seat against the bottom of the ball-containing chamber. In this condition, the ball-containing chamber will communicate with return $R_A$.

In normal operation, switches 88A are closed and the solenoid valve 90A is energized by drivers 89A. Hence, the plunger 91A is normally in the raised position, with ball 94A firmly seated against the top of the ball-containing chamber. In this condition, supply pressure $P_A$ is applied to the drive chamber 95A of active bypass valve 85A, and to the opposite end of standby bypass valve 85B.

Selector valve 85A is shown as including a four-lobed valve spool 96A slidably mounted in a cylinder. An integral rod-like member 98A extends leftwardly from the leftmost lobe of spool 96A to contact a slidable pin 99A, to the opposite end face of which standby pressure $P_B$ is supplied through standby solenoid valve 90B. Normally, the active pressure $P_A$ and the standby pressure $P_B$ are substantially identical. Persons skilled in this art will appreciate that selector valve 85A has three possible modes: (1) a "damping" mode (as shown in FIG. 5) in which opposite sides of piston 82A communicate through an orifice; (2) an "operate" mode in which the servovalves communicate with the opposite sides of piston 82A; and (3) a "standby" mode in which both sides of piston 82A communicate with return $R_A$. In the condition shown in FIG. 5, both selector valves 85A and 85B are in the "damping" condition, whereby the chambers on opposite sides of actuator piston 82A are in communication through the illustrated labyrinth of passageways including restricted orifices and check valves. In this condition, the control ports of servovalves 84A and B are blocked from communication with the actuator chambers, and the actuator will provide hydraulic damping to any externally applied loads.

When solenoid valve 90A is energized, supply pressure $P_A$ is admitted to bypass valve drive chamber 95A. This pressure acts over the circular end face area of the rightwardmost lobe. The resulting displacement of spool 96A will block the "bypassing" passageways of selector valve 88A, and will communicate the active actuator chambers with the control ports of servovalve 84A. When system A is in this active condition, the spool in the standby system is displaced to a fully bypassed condition by the application of pressure from solenoid 90A to the piston 99B, such that active servovalve 84A will control the operation of common actuator 80.

The redundant control system 79 also incorporates an automatic switching feature, which will cause system B to become active and bypass system A if a failure occurs in System A.

If the active differential position sensing mechanism 86A determines the occurrence of a failure through dissimilar movements of the spools of servovalve 84A, switches 88A will open to deenergize solenoid valve 90A. Thereafter, plunger 91A will move downwardly to seat ball 94A against the bottom of the ball-containing chamber. At the same time, the drive chambers of both bypass valves will be connected to return $R_A$ through solenoid valve 90A. The restoring forces exerted by return springs 100A and 100B, will displace both selector spools 96A and 96B to their centered positions, the damped condition shown in FIG. 5. Hence, a failure sensed by the active differential position sensing mechanism 86A will automatically deactivate system A.

Sensing of the current levels in the redundant solenoid coils will permit an external indication of the valve failure and, consequently, shut off of system A. The external electrical control will then cause energization of solenoid 90B and pressurization of selector valve 85B to activate control of the actuator from servovalve 84B. Application of pressure to piston 99A will also cause selector valve 85A to move to the standby condition.

If the active supply pressure $P_A$ should fall while the redundant control system 79 is operating normally, pressure in the spool end chambers of the servovalve will also fall. This will enable checkout springs 76A, 78A (FIG. 5) to cause dissimilar spool movements, thereby opening switches 88A through differential position sensing mechanism 86A. Hence, a sufficient drop in the active supply pressure $P_A$ will similarly result in an automatic shut-off of the active system and an "activation" of the standby system, in the manner before described.

Figure 6:
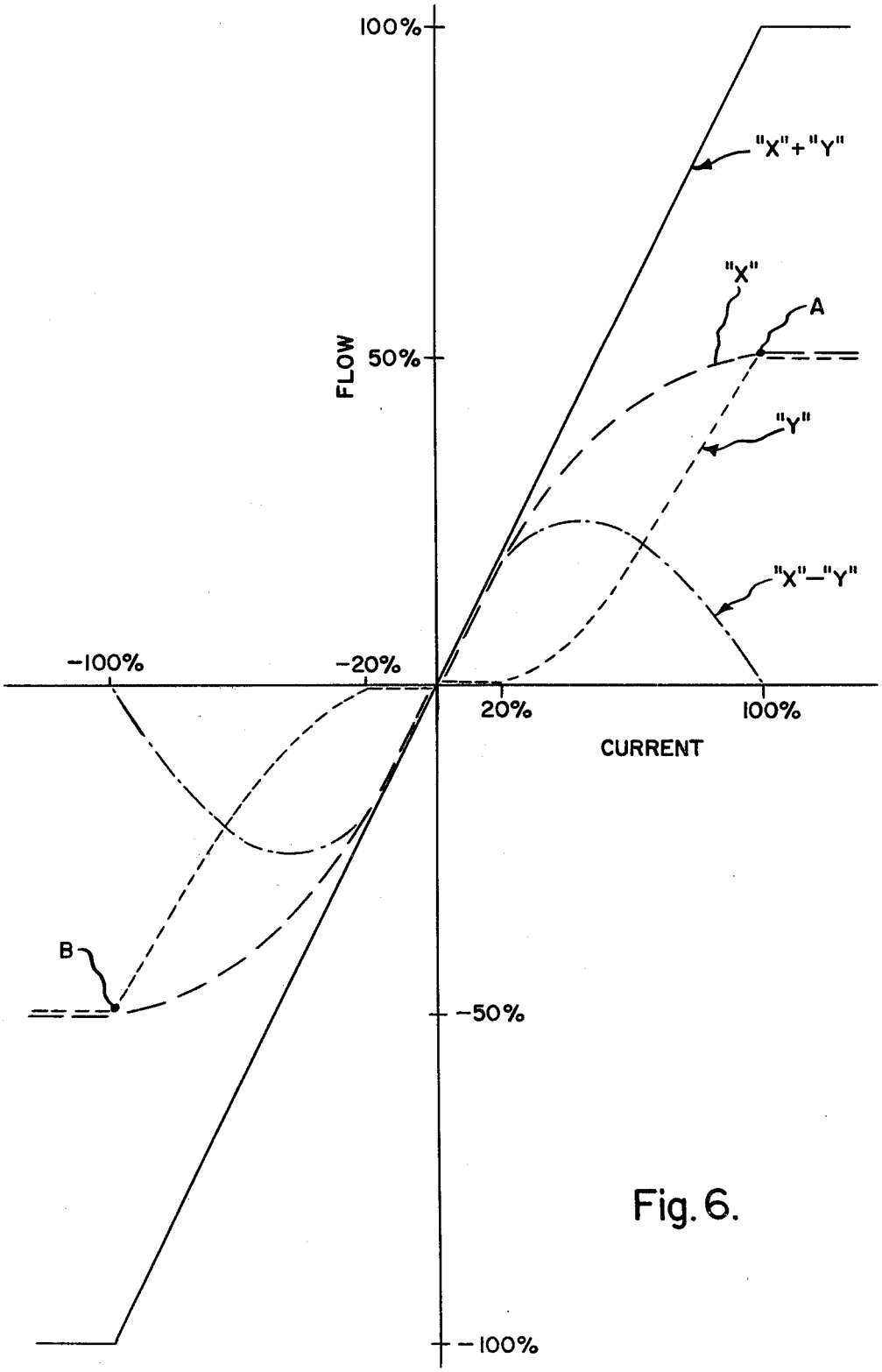
FIG. 6 is a graph showing the individual, additive and substractive flow vs. command signal characteristics of the spools.

"Hard-over" Failure Compensation in Flow-Sum Servovalve (FIG. 6)

As previously noted, the servovalve 11 depicted in FIGS. 1-3 is of the dual-spool flow-sum type, that is, the individual flows of fluid metered by valve spools 15, 16 through control ports 24, 25 are combined. Hence, the flow of the servovalve is the sum of the individual flows metered by the two spools. To take advantage of this additive effect, it is generally desired that each spool be capable of metering one-half of the maximum desired flow of the servovalve to provide a fail-safe feature described later.

In designing a servovalve, one must consider a problem known as "null shift". This stems from the combined effects of temperature and pressure levels, accelerations and the like, and typically results in a requirement that a non-zero command signal be supplied to achieve a zero flow. Simplistically, one might regard the actual position of the curve shown in FIG. 6 as shifted along the abscissa by typically ±5%, and sometimes as high as ±10%, as a result of such null shifts.

Hence, in a two-spool flow-sum servovalve, there exists the possibility that the spools may have mismatched nulls. Therefore, whatever command signal might be required to null one spool, might open the other.

To eliminate this possibility, one spool, hereinafter denominated as spool "Y", is provided with a wide "dead-zone" between ±20% of command signal. Mechanically, such a "dead zone" may be provided by having the appropriate lobes of the spool be of such width as to overlap their associated ports. Within such "deadzone", a command signal will cause the spool to move, but the lobe overlap will continue to cover the underlying port. Hence, no flow will be established until the spool has moved sufficiently far as to uncover the flow metering ports.

To provide linear velocity control of the actuator, it is desirable that the combined flow from the two valve spools increase approximately linearly with command signal current. To allow for the dead zone designed into spool "Y", the flow from spool "X" must increase with signal through the null region at the nominal rate for the combined valves, but then decrease for intermediate signals so that the maximum flow from spool "X" is only 50% of the total flow for input signals of 100% or greater. A practical way to achieve this effect is to insert appropriately sized orifices 103A, 103A (FIG. 5) in series with the flow control lines from servovalve "X". The curve labeled "X" in FIG. 6 shows such a flow versus current characteristic.

It is also desired that spool "Y" be capable of contributing one-half of the maximum servovalve flow at 100% of the command signal. Hence, while spool "Y"

has a wide "deadzone" between ±20% of command signal, the flow gain of spool Y is "shaped" to complement the flow from spool "X", such that the flow will rise from zero to ±50% when the command signal varies from ±20% to ±100%, respectively, as shown by curve "Y" in FIG. 6. Such "shaping" may be accomplished by varying the configuration of the ports uncovered by the associated lobes. Therefore, while spool Y has a deliberate dead-zone to prevent the possibility of a mismatched nulls, each of the spools is capable of metering its contributive half of maximum servovalve flow at ±100% of command signal.

FIG. 6 depicts, in solid, the combined flow vs. command signal characteristics of the dual-spool servovalve. The curve labelled "X"+"Y" is obtained by summing the curves shown as "X" and "Y".

The improved servovalve possesses a feature which compensates for a runaway or "hard-over" position of one of the spools. In FIG. 4, assume that a pilot-stage failure causes spool 15 to runaway to a "hard-over" rightward position. The resulting motion of the actuator will generate a control loop error signal between summing point 105 and amplifier 106, which will cause spool 16 to move to an opposite "hard-over" leftward position. Hence, if spool 15 permits a maximum flow in one direction, such as at point A in FIG. 6, spool 16 will permit a maximum flow in the opposite direction, such as at point B in FIG. 6.

The effect of the two spools being in opposite "hard-over" positions is shown by the dashed-dot curve in FIG. 6, which is obtained by subtracting the "Y" curve from the "X" curve in FIG. 6. It will be seen that these flows are self-cancelling at the "hard-over" positions, represented by ±100% of command signal, and will therefore prevent further runaway of the controlled actuator.

Therefore, the improved servovalve has one spool provided with a deadzone to eliminate the possibility of mismatched nulls. At the same time, the two spools have equal maximum flows. Therefore, a runaway condition of one spool toward a "hard-over" condition, which, through servo action will produce corresponding opposite movement of the other spool, will produce zero flow to the cylinder.

MODIFICATIONS

The present invention contemplates that many changes and modifications may be made.

For example, the improvement is not limited to use in a dual-spool flow-sum servovalve. The improvement could be used in other dual-spool servovalves as well. One example would be a dual-spool valve in which one spool actively metered flow, while the other acted as a non-functioning model. In such case, the improvement could be used to compare the movements of the active and model spools, and indicate an error if the spools experienced dissimilar motion. The reason for providing such a model would be to provide a basis for failure-detection comparison. While deemed desirable, the provision of the flow summing is optional to achieve fail-safe voting of the spools.

The particular servovalve (FIGS. 1–3) in which the improvement has been shown to be incorporated, is exemplary only, and is not intended to be exclusive of other possible applications. Similarly, the disclosed structural form of the improvement is believed to be but one form, albeit the best mode known to applicants, of what is perceived to be a broader invention. Hence, the claims should not necessarily be construed as being limited to the specific form of the disclosed species. While deemed preferable, the provision of the checkout springs is also optional. The redundant control system shown in FIG. 5 is also exemplary, and merely shows a possible application of the improvement in a larger system.

Therefore, while the presently preferred forms of the inventive improvement has been shown and described, and several modifications thereof discussed, persons skilled in this art will readily appreciate that various additional modifications may be made without departing from the spirit of the invention, as defined by the following claims.

What is claimed is:

1. In a servovalve having first and second members mounted for independent sliding movement relative to a body along parallel axes, having a first driver operatively arranged to cause a desired motion of said first member, and having a second driver operatively arranged to cause a simultaneous motion of said second member, the improvement which comprises:

a differential position sensing mechanism arranged to sense the relative positions of said first and second members and operative to produce an output position related to the differential position therebetween, said mechanism including a first part operatively associated with each member and mounted for movement therewith pivotally about an axis arranged in a plane substantially perpendicular to the axis of one of said members, and including a second part operatively associated with said first part and mounted for pivotal movement about an axis substantially perpendicular to said first part pivotal axis and arranged in a plane substantially perpendicular to said one member axis; and an indicating device supplied with said output and operative to indicate dissimilar relative positions of said first and second members.

2. The improvement as set forth in claim 1 wherein said differential position sensing mechanism is operatively arranged to permit simultaneous similar motion of said members without producing said output position.

3. The improvement as set forth in claim 1 wherein said first and second members are urged to move in opposite directions when said servovalve is unpressurized.

4. The improvement as set forth in claim 1 wherein backlash in said differential position sensing mechanism may accommodate an insubstantial differential in relative member position without operating said indicating device.

5. The improvement as set forth in claim 1 wherein said indicating device is a snap-action switch.

6. The improvement as set forth in claim 5 and further comprising a solenoid valve and a solenoid driver, and wherein said snap-action switch is directly connected to cause said solenoid valve to be selectively deenergized in response to the output of said differential position sensing mechanism.

7. The improvement as set forth in claim 6 wherein said solenoid driver is arranged to supply a high level current for a short duration to displace the plunger of said solenoid valve, and is arranged to thereafter supply a reduced level current to hold said plunger in its displaced position.

8. The improvement as set forth in claim 7 wherein the level of said current may remotely indicate the condition of said solenoid valve.

9. The improvement as set forth in claim 7 wherein said solenoid driver may supply a further reduced current level to test the continuity of said solenoid valve and switch circuit without displacing said solenoid plunger.

10. The improvement as set forth in claim 9 wherein said servovalve is of the flow-sum type.

11. The improvement as set forth in claim 1 wherein at least one of said members is arranged to meter a flow of fluid.

12. The improvement as set forth in claim 11 wherein one of said members is provided with a dead zone.

13. The improvement as set forth in claim 12 and further comprising at least one restricted orifice in series with the variable flow-metering orifice of the other of said members.

14. The improvement as set forth in claim 11 wherein both of said members are arranged to meter flows of fluid, and wherein the maximum flows metered by said members are equal.

15. The improvement as set forth in claim 1 wherein, during simultaneous motion of said members, said first part may move pivotally about its axis without causing pivotal movement of said second part about its axis.

16. The improvement as set forth in claim 1 wherein said second part may move pivotally about its axis only during dissimilar motion of said members.

17. The improvement as set forth in claim 1 wherein the magnitude of angular movement of said second part is proportional to the magnitude of the differential movement of said members.

18. The improvement as set forth in claim 1 wherein said first part is physically connected to each of said members.

19. The improvement as set forth in claim 1 wherein each of said members is a valve spool.

20. In a servovalve having first and second members mounted for independent sliding movement relative to a body along parallel axes, having a first driver operatively arranged to cause a desired motion of said first member, and having a second driver operatively arranged to cause a desired simultaneous motion of said second member, the improvement which comprises:

a differential position sensing mechanism arranged to sense the relative positions of said members and operative to move pivotally about one axis when said members move similarly and to move about another axis when said members move dissimilarly for causing an arcuate output position in a plane only when said members move dissimilarly; and an indicating device supplied with said output position and operative to indicate dissimilar movement of said members.

21. The improvement as set forth in claim 20 wherein said output position plane is parallel to the plane including said member axes.

22. The improvement as set forth in claim 21 wherein said output position plane is spaced from the plane including said member axes.

23. The improvement as set forth in claim 20 wherein said differential position sensing mechanism includes a first part engaging each of said members and mounted for movement pivotally about an axis substantially perpendicular to said member axes, and includes a second part engaging said first part and mounted for pivotal movement about an axis substantially perpendicular to said member axes and substantially perpendicular to the axis of said first part.

24. The improvement as set forth in claim 23 wherein said differential position sensing mechanism physically contacts each of said members.

25. The improvement as set forth in claim 20 wherein the magnitude of said output position is proportional to the magnitude of the differential of dissimilar movement of said members.

26. The improvement as set forth in claim 20 wherein said members move in the same direction when said members move similarly.

* * * * *